US005083127A

United States Patent [19]

Frye et al.

[11] Patent Number: 5,083,127

[45] Date of Patent: Jan. 21, 1992

[54] THERMAL BARRIER FACADE CONSTRUCTION OF HIGH RISE STRUCTURES AND A PROCESS FOR FABRICATION OF A THERMAL BARRIER

[75] Inventors: Andreas Frye, Vechta; Jürgen Kruse, Genderkesee; Julius Weyand, Bremen Borgfeld; Joachim Bettermann, Delmenhorst; Dirk Bringmann, Bremen, all of Fed. Rep. of Germany

[73] Assignee: Messerschmitt-Bölkow-Blohm GmbH, Fed. Rep. of Germany

[21] Appl. No.: 465,937

[22] Filed: Jan. 16, 1990

[30] Foreign Application Priority Data

Jan. 13, 1989 [DE] Fed. Rep. of Germany ..... 3900857

[51] Int. Cl.[5] ..... H01Q 17/00

[52] U.S. Cl. ..... 342/1; 52/235

[58] Field of Search ..... 342/1, 4; 52/235

[56] References Cited

U.S. PATENT DOCUMENTS

| | | | |
|---|---|---|---|
| 4,012,738 | 3/1977 | Wright . | |
| 4,118,704 | 10/1978 | Ishino et al. | 342/ |
| 4,162,496 | 7/1979 | Downen et al. | 342/ |
| 4,173,018 | 10/1979 | Dawson et al. | 342/ |
| 4,327,364 | 4/1982 | Moore . | |
| 4,522,890 | 6/1985 | Volkers et al. | 342/ |

FOREIGN PATENT DOCUMENTS

| | | |
|---|---|---|
| 0121655 | 10/1984 | European Pat. Off. . |
| 0210803 | 2/1987 | European Pat. Off. . |
| 1760260 | 10/1956 | Fed. Rep. of Germany . |
| 1842857 | 3/1961 | Fed. Rep. of Germany . |
| 3131137 | 2/1983 | Fed. Rep. of Germany . |
| 3307066 | 9/1984 | Fed. Rep. of Germany . |
| 669628 | 3/1989 | Switzerland . |
| 893007 | 4/1962 | United Kingdom . |
| 2058469 | 4/1981 | United Kingdom . |

OTHER PUBLICATIONS

IEEE Transactions on Broadcasting, vol. BC-25, No. 4, Dec. 1979, pp. 143-146.

"Hochfrequenz-absorbierende Materialien", Hans Domink et al., Elektromagnetische Verträglichkett, vol. 5, pp. 280-283.

*Primary Examiner*—Mark Hellner

*Attorney, Agent, or Firm*—Toren, McGeady & Associates

[57] ABSTRACT

It is intended to arrange a thermal barrier layer ahead of structural parts reflecting electromagnetic waves in the region of radar waves, in order to provide an absorption or a reduction of the reflection. For this purpose electrically and/or magnetically conductive materials are embedded in a material from an electric insulator for forming conductive regions. The dimensions of these conductive regions are in all planes at least a thousand times smaller than the wavelengths of the waves to be absorbed, wherein the electrically and/or magnetically conductive materials comprise a share of up to 10% of the volume of the thermal barrier layer. Herein it is provided to design the upstream cover from an electric insulator.

8 Claims, 1 Drawing Sheet

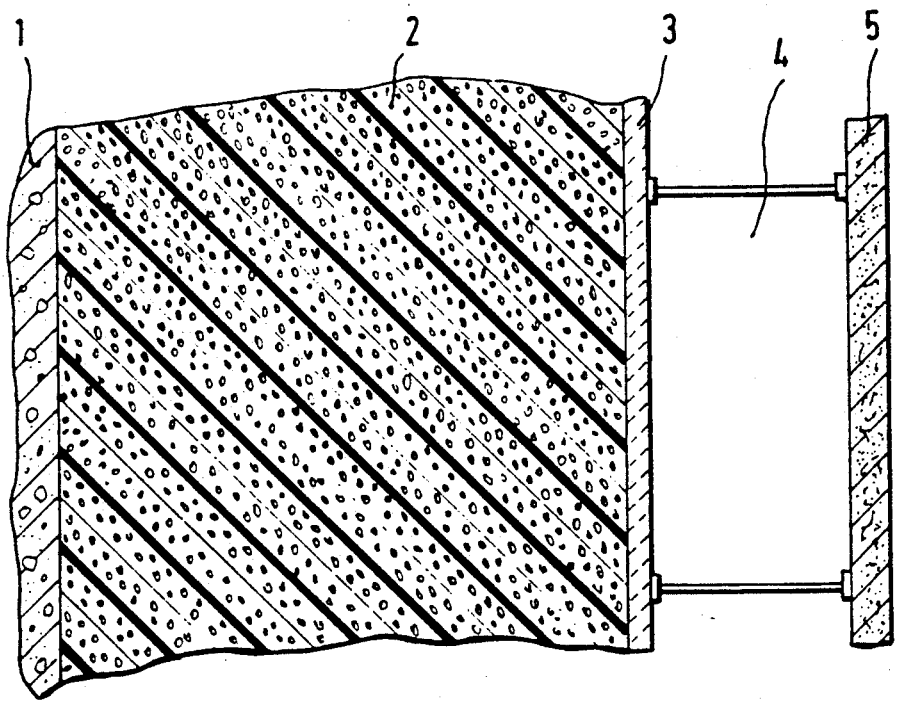
1
2
3
4
5

THERMAL BARRIER FACADE CONSTRUCTION OF HIGH RISE STRUCTURES AND A PROCESS FOR FABRICATION OF A THERMAL BARRIER

BACKGROUND OF THE INVENTION

The invention is directed to a facade construction of high rise structures, such as buildings, especially with thermal barrier design, wherein the external side of the facade is formed by a cover and a thermal barrier is arranged between the building wall and the cover. The invention is further directed to the fabrication of a thermal barrier.

Such designs are known and serve, in addition, for weatherproofing a facade lining constituting aesthetic elements of the buildings. It has, however, been seen that problems arise because of the large geometric dimensions of the buildings and the thus formed large area flat contours, particularly when electrically conducting or magnetic materials are used, if such structures are located in direct proximity of directional radio beacons and airport surveillance radar. In such cases reflections are produced by these buildings which generate erroneous receptions at ranges up to 100 km for instance in connection with aircraft transponders.

SUMMARY OF THE INVENTION

It is an object of the present invention to create a facade buildup of the generic type and a process for the fabrication of a thermal barrier, wherein the dampening, reflection or the absorption of the occurring electromagnetic waves is made possible in a simple way and thus an impairment of directional radio beacons and airport surveillance radar installations is avoided.

Pursuant to this object, and others which will become apparent hereafter, one aspect of the present invention resides in arranging the thermal barrier layer ahead of the structural elements reflecting electromagnetic waves in the region of radar waves in the external region of the building wall. The thermal barrier consisting of material absorbing electromagnetic waves, and the material being a foamed plastic material as an electric insulator, into which conductive and/or magnetic materials are embedded in order to form conductive regions, whose dimensions in all planes are at least 1000 times smaller than the wavelengths of the electromagnetic waves to be absorbed and which comprise a share of up to 10% of the volume of the thermal barrier layer. A further aspect of the invention resides in fabricating the upstream cover from an electric insulator.

By this design the impinging waves are essentially absorbed or dampened by the conductive regions thus formed, by converting the wave energy into heat.

Furthermore it is proposed that the thickness of the thermal barrier layer is dimensioned so that the energy of the electric waves impinging upon the reflecting structural components becomes nearly zero.

A favorable design is created when soot particles are arranged as the electrically conducting material.

Furthermore, iron carbonyl powder can be used as the magnetic material.

In order to achieve a favorable absorption, the thermal barrier layer is structured as several layers, which respectively comprise differing concentrations of electrically and/or magnetically conductive materials.

In order to satisfy possibly required fire control statues, the thermal barrier layers intended for absorption comprises an additional layer of fireproof material for protection against flames at its external side.

Furthermore, a metallic screening by way of an antenna for reflection is arranged in the external layer and a subtraction is accomplishable by differing travel times of reflected electromagnetic wave shares.

A process is proposed for fabricating the thermal barrier which provides that a large- and open pore plastics material foam is utilized as a base frame for formation of an electric insulator, into which electrically and/or magnetically conductive materials are embedded by means of a sputtering process, with the basic frame being subsequently foamed by a plastics material having fine cells.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

An example of a facade structure pursuant to the present invention is schematically shown in section in the single figure.

DETAILED DESCRIPTION OF THE PREFERRED EMBODIMENTS

A thermal barrier layer 2 is applied to a building wall 1 consisting of reinforced concrete. The layer is designed in the form of panel area elements or webs.

The thermal barrier 2 is composed of a foam material such as polyurethane, being an electric insulator, into which electrically and/or magnetically conductive materials are embedded. Conductive regions are formed by these materials, such as soot particles or iron carbonyl powder, whose dimensions in all planes are at least 1000 times smaller than the wavelength of the electromagnetic wave to be absorbed and which comprises a share of up to 10% of the volume of the thermal barrier.

A layer 3 of fireproof material for protection against flames is applied additionally upon the absorbing thermal barrier layer 2, provided such protection is not assured by the thermal barrier 2 itself.

Furthermore, a cover 5 forming the external side of the facade is arranged with interposition of an air layer 4. The cover consists of an electrical insulator such as a Resoplan, Trespa or fiber cement.

While the invention has been illustrated and described as embodied in a thermal barrier facade construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. A facade construction for high rise structures, comprising a thermal barrier facade external side formed by a cover; and a thermal barrier layer arranged between a building wall and the cover, the thermal barrier layer being arranged ahead of structural elements which reflect electromagnetic waves in the region of radar waves in an outer area of the building wall and consisting of materials which absorb electromagnetic waves, said materials being constituted by foamed plastics as an electric insulator, into which at least one of electrically conductive and magnetic materials are embedded so as to form conductive regions, the conductive regions having dimensions in all planes at least a thousand times smaller than the wavelengths of the electromagnetic waves to be absorbed and make up a share of up to 10% of the volume of the thermal barrier layer, the cover being located. ahead of the thermal barrier, and the wall consisting of an electric insulator.

2. A facade construction according to claim 1, wherein the thermal barrier layer has a thickness dimensioned so that energy of the electromagnetic waves impinging upon the reflecting structural members becomes nearly zero.

3. A facade construction according to claim 1, wherein the electrically conductive materials are soot particles.

4. A facade construction according to claim 1, wherein the magnetic material is iron carbonyl powder.

5. A facade construction according to claim 1, wherein the thermal barrier layer is built up of several layers comprising respectively different concentrations of at least one of electrically and magnetically conductive materials.

6. A facade construction according to claim 1, wherein the thermal barrier layer for absorption comprises at its external side a layer of fireproof material.

7. A facade construction according to claim 1, wherein a metallic screen for reflection is arranged in the cover so that a substraction is accomplishable due to the differing travel times of the reflected electromagnetic wave shares.

8. A facade construction according to claim 7, wherein the metallic screen is an antenna.

* * * * *